US006644290B2

(12) United States Patent
Yoneyama et al.

(10) Patent No.: US 6,644,290 B2
(45) Date of Patent: Nov. 11, 2003

(54) ENGINE BREATHER SYSTEM

(75) Inventors: Tadayuki Yoneyama, Saitama (JP); Yukio Sugimoto, Saitama (JP); Koji Satake, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/281,268

(22) Filed: Oct. 28, 2002

(65) Prior Publication Data

US 2003/0089352 A1 May 15, 2003

(30) Foreign Application Priority Data

Oct. 26, 2001 (JP) ..... 2001-328652

(51) Int. Cl.[7] ..... F01M 11/02
(52) U.S. Cl. ..... 123/572; 123/574
(58) Field of Search ..... 123/572, 573, 123/574, 41.86

(56) References Cited

U.S. PATENT DOCUMENTS 4,103,650 A * 8/1978 Nishida et al. ..... 123/41.86
4,721,090 A * 1/1988 Kato ..... 123/572
5,951,344 A * 9/1999 Tsunoda et al. ..... 123/572
6,029,638 A * 2/2000 Funai et al. ..... 123/572
6,439,215 B1 * 8/2002 Sato et al. ..... 123/572

FOREIGN PATENT DOCUMENTS

JP 62-240413 10/1987

* cited by examiner

*Primary Examiner*—Marguerite McMahon
(74) *Attorney, Agent, or Firm*—Arent Fox Kintner Plotkin & Kahn, PLLC

(57) ABSTRACT

An engine breather system is formed from a first breather chamber communicating with a crank chamber formed within a crankcase, a second breather chamber communicating with the crank chamber as well as with an intake system, a communicating passage connecting the first and second breather chambers, and a one-way valve. The valve is provided at an open end on the second breather chamber side of the communicating passage, so as to prevent breather gas from flowing from the second breather chamber toward the first breather chamber. The one-way valve is provided with a pressure relief hole, which prevents oil from leaking into the intake system accompanying continued operation of the engine in an attitude different from its normal attitude.

5 Claims, 7 Drawing Sheets

11
12
13
16
64
65
66
67
68
69
86
L

ENGINE BREATHER SYSTEM

BACKGROUND OF THE INVENTION

1. Field of the Invention

The present invention relates to a breather system for a general-purpose four-cycle engine mounted in a work machine such as a construction machine or an earth moving machine, and in particular to an improvement of an engine breather system.

2. Description of Related Art

Conventional engine breather systems, such as the one disclosed in Japanese Patent Application Laid-open No. 62-240413, teach that the one-way valve works to maintain the pressure of the crank chamber appropriately so that breather gas flows from the first breather chamber to the intake system via the second breather chamber only when the pressure of the crank chamber increases.

A work machine, such as a rammer, might be positioned at an orientation (attitude) different from its normal standing orientation during operation due to operating error, unstable ground, etc. If the operation of the engine is continued in such an irregular orientation in the conventional arrangement, the oil within the crankcase might leak into the intake system. The first breather chamber is filled with oil so that the oil level is above the open end on the first breather chamber side of the communicating passage connecting the first and second breather chambers. Assuming the first breather chamber is below the second breather chamber, the one-way valve remains closed when the crank chamber has a negative pressure, although the negative pressure works on the first and second breather chambers. When the crank chamber has a positive pressure, since the oil within the communicating passage ascends within the communicating passage while opening the one-way valve by the action of the positive pressure imposed on the first and second breather chambers, continued operation of the engine makes the oil ascend within the communicating passage and supplies the oil to the second breather chamber. This creates the possibility that the oil within the second breather chamber will leak into the intake system.

The present invention has been carried out in view of the above circumstances It is an object of the present invention to provide an engine breather system that prevents oil from leaking into an intake system accompanying continuous operation of an engine in an attitude different from a normal attitude.

BRIEF SUMMARY OF THE INVENTION

In order to achieve the object above, the present invention provides an engine breather system that includes a first breather chamber communicating with a crank chamber formed within a crankcase and a second breather chamber communicating with the crank chamber as well as with an intake system. The engine breather system also includes a communicating passage connecting the first and second breather chambers, and a one-way valve provided at an open end, on the second breather chamber side of the communicating passage so as to prevent breather gas from flowing from the second breather chamber toward the first breather chamber, wherein the one-way valve is provided with a pressure relief hole.

In accordance with this arrangement, in the case where operation of the engine is continued in a state in which the first breather chamber is below the second breather chamber, the first breather chamber being filled with oil so that the oil level is above the open end, on the first breather chamber side, of the communicating passage, when the crank chamber has a negative pressure, the upper space above the oil surface within the communicating passage communicates with the second breather chamber due to the pressure relief hole provided in the one-way valve in spite of the one-way valve being closed. Therefore, the oil level within the communicating passage decreases. The oil level within the communicating passage thus only repeatedly increases and decreases when operation of the engine is continued. Also, the oil is not pushed up toward the second breather chamber, thereby preventing the oil from leaking into the intake system.

Modes for carrying out the present invention are explained below by reference to an embodiment of the present invention shown in the attached drawings.

BRIEF DESCRIPTION OF THE DRAWINGS

FIGS. 1 to 7 illustrate one embodiment of the present invention.

FIG. 1 is a vertical cross section of an engine.

FIG. 2 is a cross section along line 2—2 in FIG. 1.

FIG. 3 is a bottom view of an engine block from arrow 3 in FIG. 1.

FIG. 4 is a magnified cross section along line 4—4 in FIG. 1.

FIG. 5 is a magnified cross section along line 5—5 in FIG. 2.

FIG. 6 is a magnified cross section along line 6—6 in FIG. 2.

DETAILED DESCRIPTION OF THE INVENTION

Figure 1:
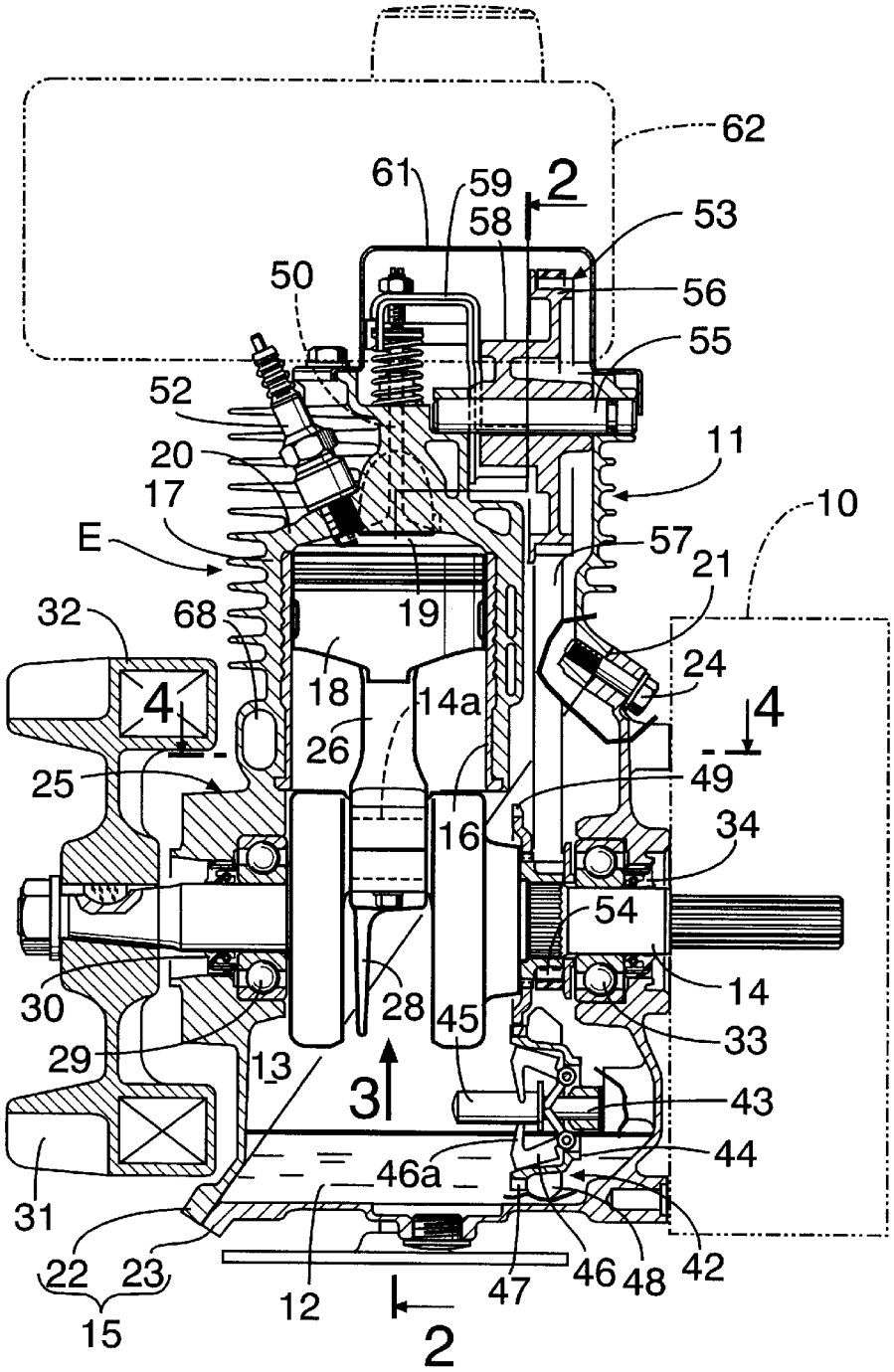
Figure 2:
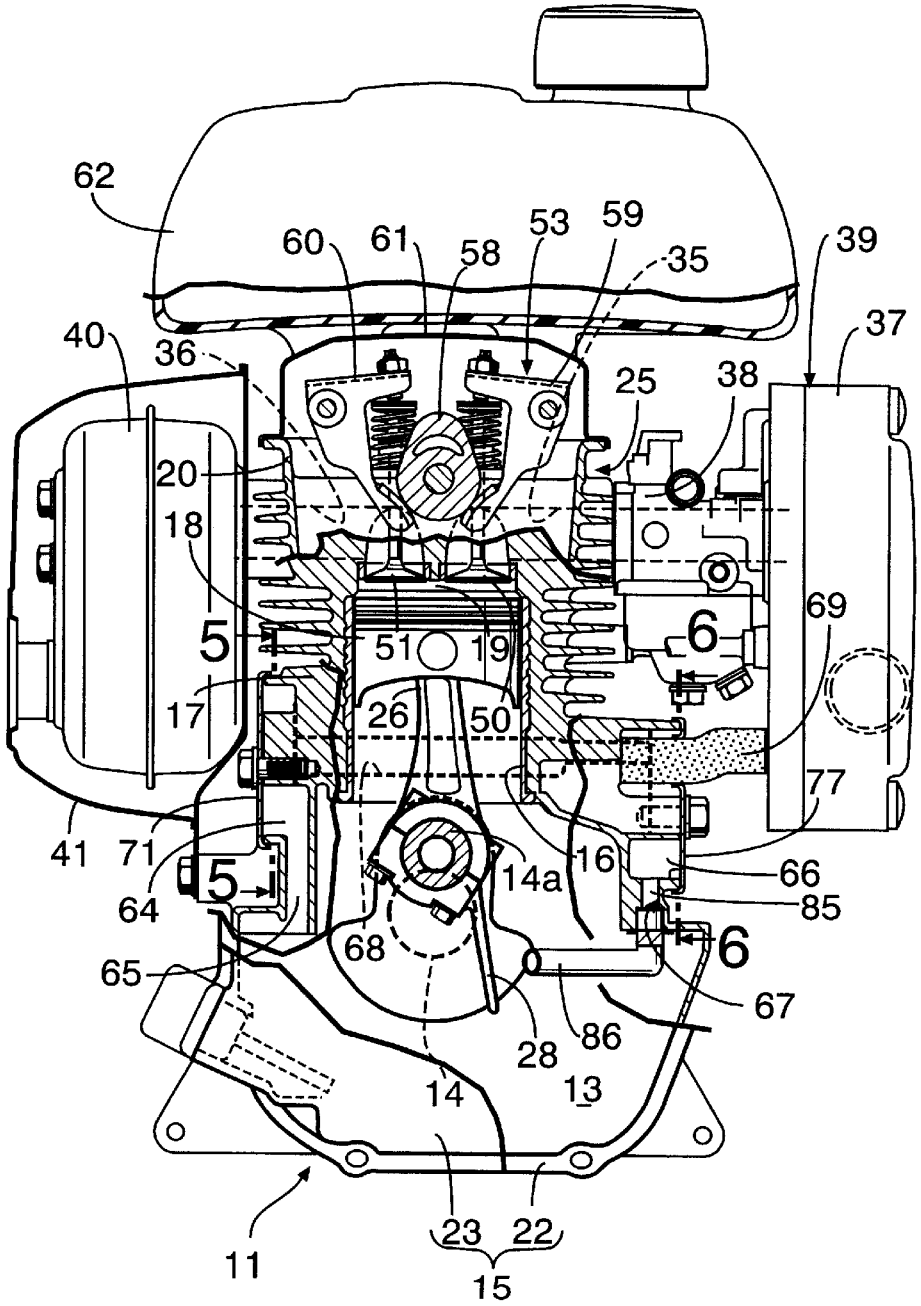

In FIGS. 1 and 2, an engine main body 11 of a four-cycle engine E for driving a rammer 10, which is a work machine, has a crankcase 15, a cylinder barrel 17 and a cylinder head 20. The crankcase 15 forms a crank chamber 13 for storing oil 12 and supports a crankshaft 14. The axis of the crankshaft 14 is substantially horizontal when the rammer 10 is being used. The cylinder barrel 17 includes a cylinder bore 16 having its axis substantially vertical when the rammer 10 is being used. The cylinder head 20, together with the top of a piston 18, which is slidably fitted in the cylinder bore 16, define a combustion chamber 19.

The crankcase 15 has a first case half 22 and a second case half 23 that are joined to each other by a plurality of bolts 24 and can be separated from each other on a dividing plane 21 that lies at an angle to the axis of the crankshaft 14. An engine block 25 is formed by integrally casting the first case half 22, the cylinder barrel 17, and the cylinder head 20.

The piston 18 is linked to a crank pin 14*a* of the crankshaft 14 via a connecting rod 26. An oil dipper 28 for splashing the oil 12 within the crank chamber 13 is made integrally with the large end of the connecting rod 26.

One end of the crankshaft 14 projects outside the crankcase 15 through a ball bearing 29 and an annular seal 30 that are present between the crankshaft 14 and the first case half 22. A flywheel 32 having an integral cooling fan 31 is fixed to the end of the crankshaft 14 outside the crankcase 15.

The other end of the crankshaft 14 projects outside the crankcase 15 through a ball bearing 33 and an annular seal 34 that are present between the crankshaft 14 and the second case half 23. The rammer 10 is connected to the other end of the crankshaft 14 outside the crankcase 15.

The cylinder head 20 includes an intake port 35 and an exhaust port 36, which are able to communicate with the combustion chamber 19. An intake system 39 including an air cleaner 37 and a carburetor 38 is supported on the cylinder head 20 so as to communicate with the intake port 35. A muffler cover 41 covers an exhaust muffler 40, which communicates with the exhaust port 36, and the engine block 25 supports the muffler cover 41.

A centrifugal governor 42 for speed adjustment is mounted on the second case half 23 at a position beneath the crankshaft 14 when the rammer 10 is being used. This centrifugal governor 42 has a rotating disc 44, a tubular slider 45, and a plurality of pendular type centrifugal weights 46. The rotating disc 44 is rotatably supported by a support shaft 43 fixed to the inner surface of the second case half 23. The slider 45 is slidably fitted around the support shaft 43. The centrifugal weights 46 are swingably supported on the rotating disc 44 so as to hold the slider 45. Each of the centrifugal weights 46 has an operation arm 46*a* that slides the slider 45 in one direction when the centrifugal force makes the centrifugal weights 46 swing outward in the radial direction of the rotating disc 44.

A driven gear 47 and oil splashing vanes 48 are formed integrally with the outer periphery of the rotating disc 44. The driven gear 47 meshes with a drive gear 49 fixed to the crankshaft 14. The support shaft 43 is provided on the second case half 23 at a position such that the oil splashing vanes 48 on the outer periphery of the rotating disc 44 are immersed in the oil 12 within the crank chamber 13.

In this type of centrifugal governor 42 for speed adjustment, the rotating disc 44 rotates accompanying rotation of the crankshaft 14, and the slider 45 accordingly slides in one axial direction of the support shaft 43. The sliding action of the slider 45 is then transmitted to a throttle valve (not illustrated) of the carburetor 38 via a link (not illustrated) so as to control the rotational speed of the engine at a set rotational speed.

An intake valve 50 and an exhaust valve 51 are provided in the cylinder head 20 in a manner such that they can open and close, and an ignition plug 52 facing the combustion chamber 19 is mounted in the cylinder head 20. The intake valve 50 controls the provision and blockage of communication between the intake port 35 and the combustion chamber 19. The exhaust valve 51 controls the provision and blockage of communication between the combustion chamber 19 and the exhaust port 36.

The intake valve 50 and exhaust valve 51 are opened and closed by a valve operation mechanism 53. The valve operation mechanism 53 has a drive timing pulley 54, a driven timing pulley 56, an endless timing belt 57, a cam 58, and rocker arms 59 and 60. The drive timing pulley 54 is fixed to the crankshaft 14 together with the drive gear 49. The driven timing pulley 56 is supported by a shaft 55 supported in the cylinder head 20. The endless timing belt 57 is wound around the drive timing pulley 54 and the driven timing pulley 56. The cam 58 is provided so as to be connected to the driven timing pulley 56. The rocker arms 59 and 60 are provided between the cam 58 and the intake valve 50 and the exhaust valve 51 respectively. The rocker arms 59 and 60 are swingably carried in a head cover 61 made of a synthetic resin. The head cover 61 is joined to the cylinder head 20 so as to cover a part of the valve operation mechanism 53. A fuel tank 62 is formed integrally with the head cover 61.

Figure 3:
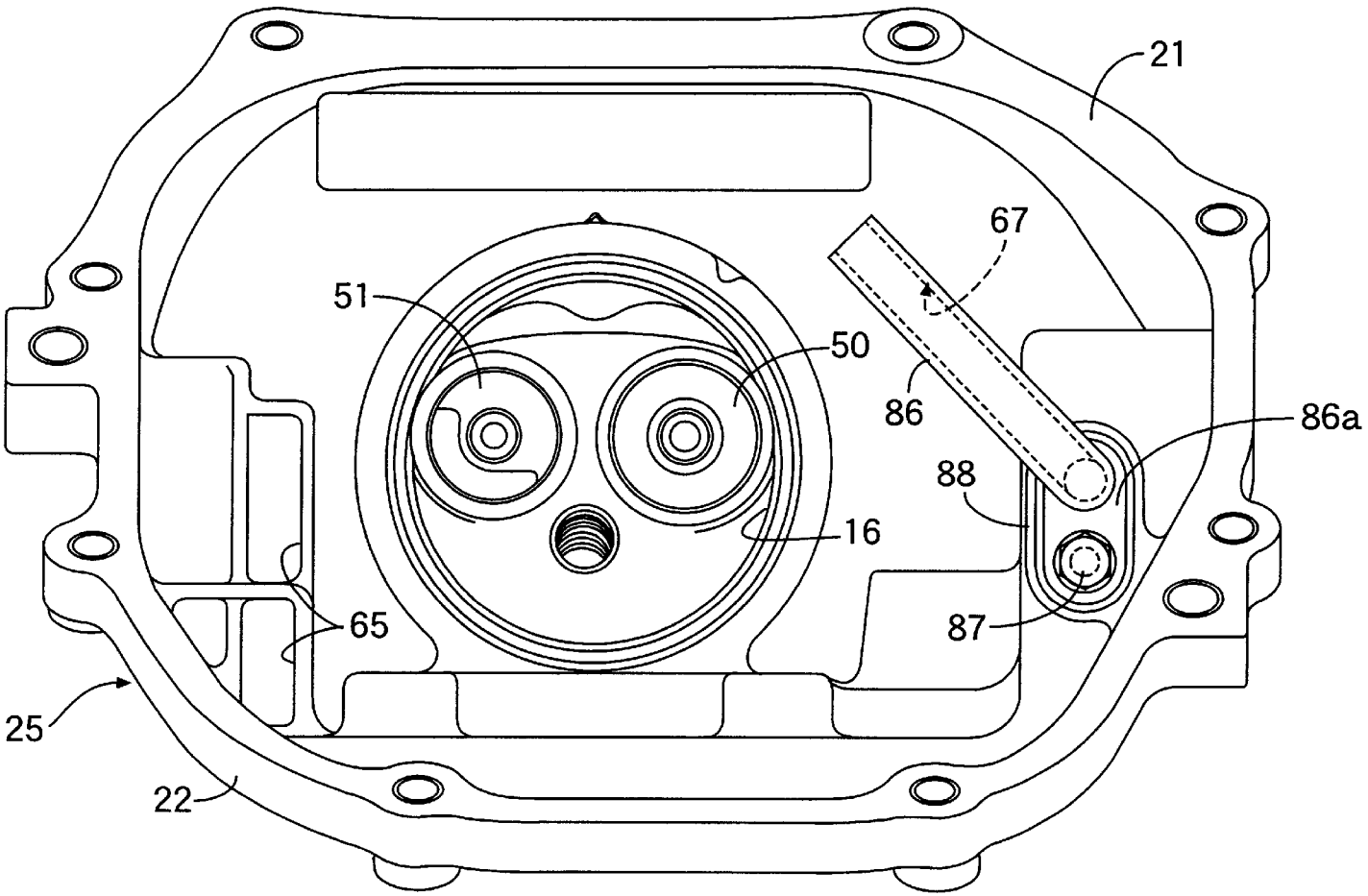
Figure 4:
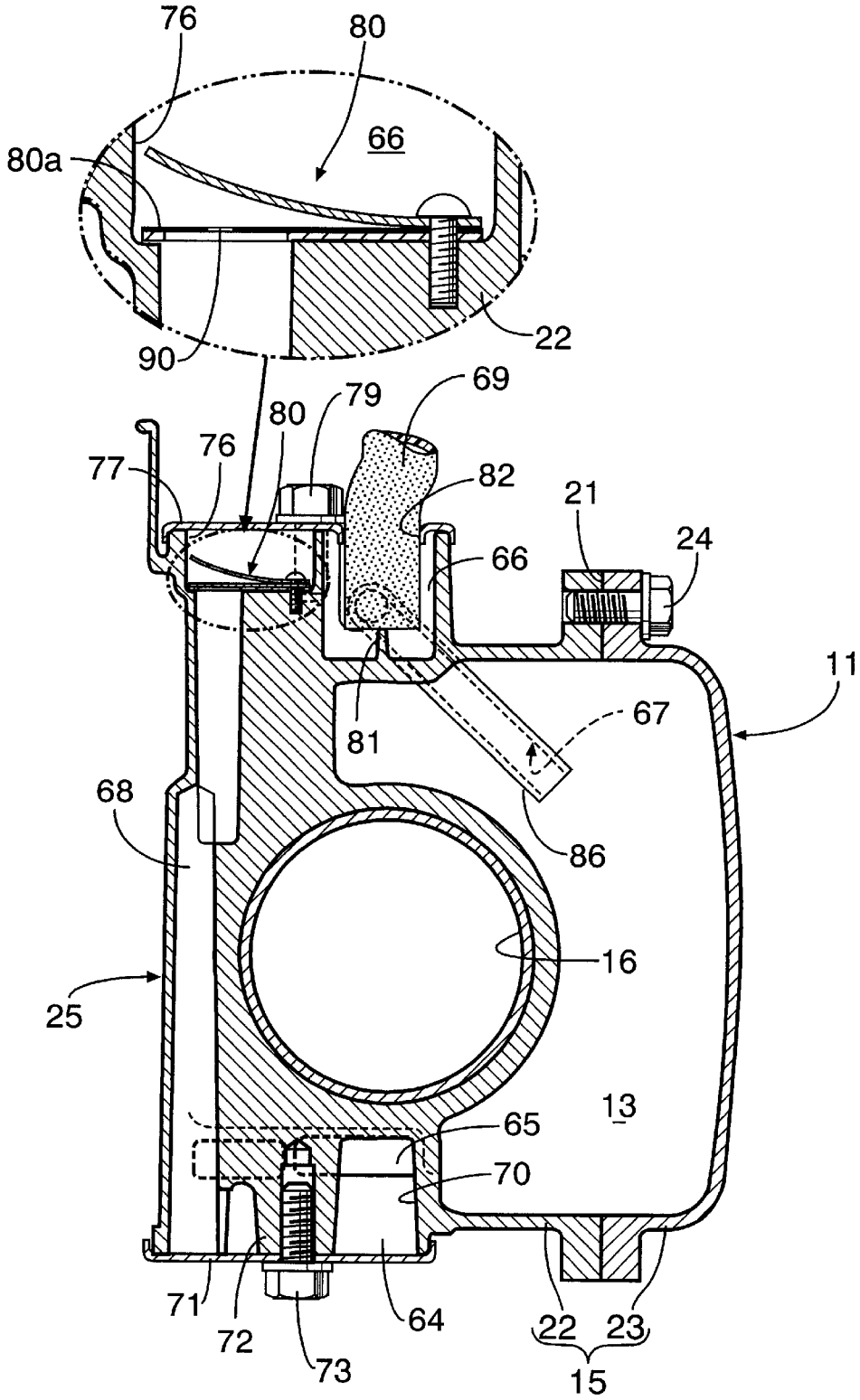

In FIGS. 3 and 4, the engine block 25 of the engine main body 11 includes a first breather chamber 64, a first through passage 65, a second breather chamber 66, a second through passage 67, and a communicating passage 68 for connecting the first and second breather chambers 64 and 66. The first breather chamber 64 is placed at a position that is substantially 180 degrees, along the circumferential direction of the cylinder bore 16, away from the position corresponding to the intake system 39. The first through passage 65 provides communication between the first breather chamber 64 and the crank chamber 13. The second breather chamber 66 is placed in the vicinity of the intake system 39 on the side substantially opposite the first breather chamber 64 relative to the axis of the cylinder bore 16. The second through passage 67 provides communication between the second breather chamber 66 and the crank chamber 13. The second breather chamber 66 is connected to the air cleaner 37 of the intake system 39 via a pipe 69, which can be, for example, a rubber hose.

Figure 5:
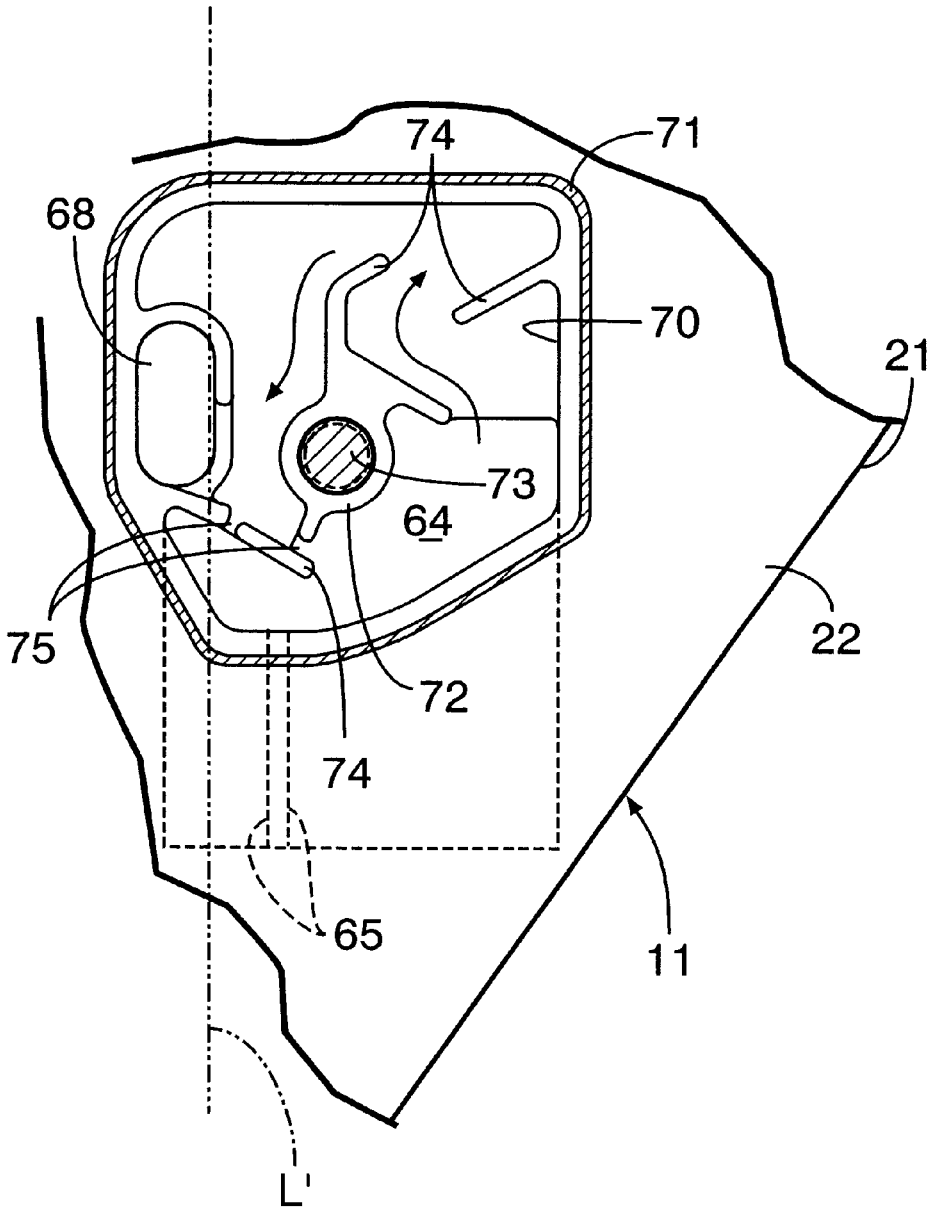

Referring additionally to FIG. 5, a cavity 70 is provided on the outer surface of the first case half 22 of the engine block 25 on the side opposite the side where the intake system 39 is disposed. A cover 71 covering the cavity 70 is joined to the outer surface of the first case half 22. The first breather chamber 64 is formed between the first case half 22 and the cover 71 so that the first breather chamber 64 is positioned above the oil level within the crank chamber 13 when the rammer 10 is being used, the first through passage 65 is provided in the first case half 22 so that the first through passage 65 communicates with the lower part of the first breather chamber 64 when the rammer 10 is being used, and the open end of the first through passage 65 is split into two in the crank chamber 13.

The communicating passage 68 is provided in the first case half 22 so as to be positioned in a plane that is perpendicular to the axis of the cylinder bore 16. One end of the communicating passage 68 opens within the cavity 70 so as to communicate with the first breather chamber 64.

A boss 72 is provided so as to project from the outer surface of the first case half 22 in substantially the center of the cavity 70. The cover 71 is secured to the first case half 22 by a bolt 73 screwed into the boss 72. A plurality of labyrinth-forming walls 74 are projectingly provided on the outer surface of the first case half 22 within the cavity 70 so as to be in contact with the cover 71. A labyrinth providing a connection between the first through passage 65 and the communicating passage 68 is formed within the first breather chamber 64 by these labyrinth-forming walls 74. Thus, breather gas introduced into the first breather chamber 64 via the first through passage 65 from the crank chamber 13 when the rammer 10 is being used flows through the labyrinth within the first breather chamber 64 and then reaches the communicating passage 68. The changes in direction of flow of the breather gas in the labyrinth allow the accompanying oil to be separated from the breather gas. Moreover, return holes 75 that have a reduced flow area so as to minimize the flow of breather gas through them are provided on the labyrinth-forming wall 74 positioned below the open end of the communicating passage 68 in a section on the communicating passage 68 side of the labyrinth in order to return the thus-separated oil to the first through passage 65 side.

Figure 6:
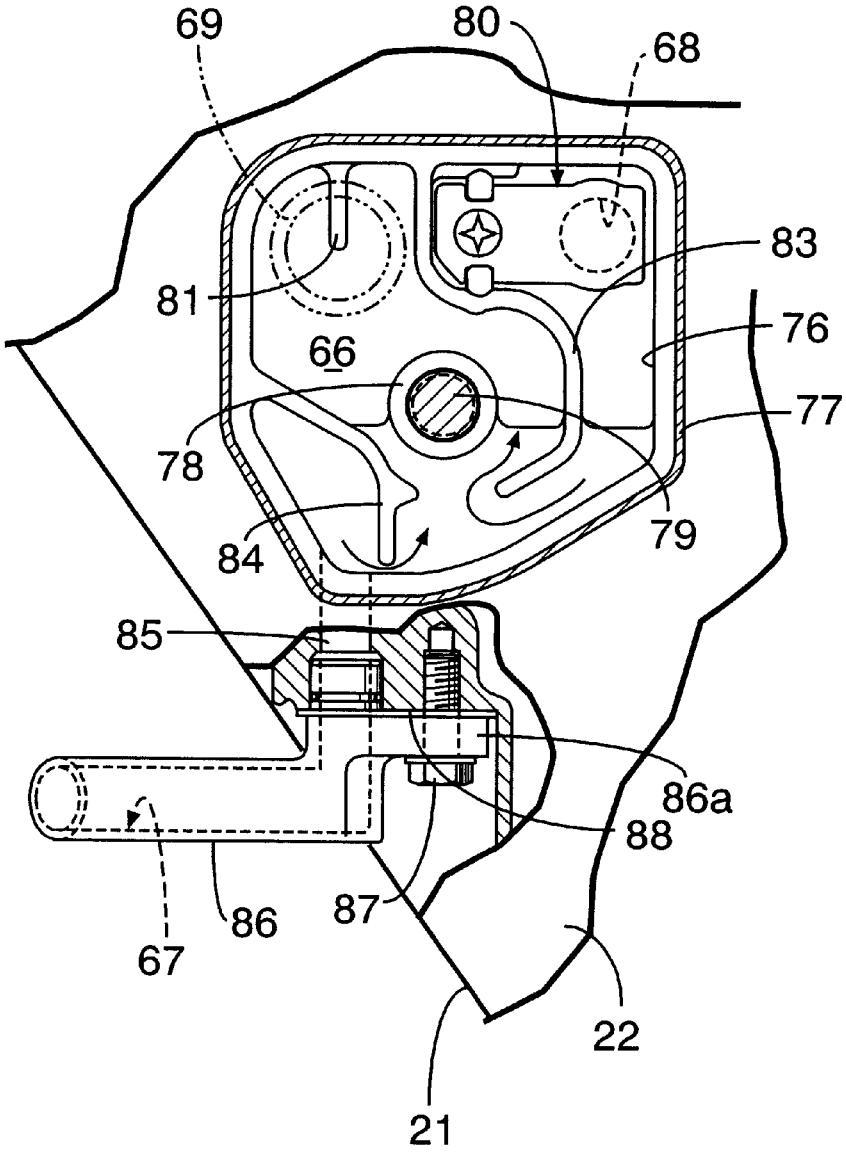

Referring additionally to FIG. 6, a cavity 76 is provided on the outer surface of the first case half 22 of the engine block 25 in the vicinity of the intake system 39 on the side substantially opposite the first breather chamber 64 relative to the axis of the cylinder bore 16. A cover 77 covering the cavity 76 is joined to the outer surface of the first case half 22. In this way, the second breather chamber 66 is formed between the first case half 22 and the cover 77 so that the second breather chamber 66 is positioned above the oil level within the crank chamber 13 when the rammer 10 is being used. The other end of the communicating passage 68 opens into the cavity 76 so as to communicate with the upper part of the second breather chamber 66 when the rammer is being used.

A boss 78 is projectingly provided on the outer surface of the first case half 22 in substantially the center of the cavity 76. The cover 77 is secured to the first case half 22 by a bolt 79 that is screwed into the boss 78. A reed valve 80, which is a one-way valve for preventing the breather gas from flowing into the communicating passage 68 from the second breather chamber 66, is attached to the first case half 22 within the cavity 76 so that its valve body 80*a* closes the open end at the other end of the communicating passage 68, that is, the end that opens into to the second breather chamber 66. The valve body 80*a* of the reed valve 80 is provided with a pressure relief hole 90 as clearly shown in FIG. 4.

A projection 81 is provided on the outer surface of the first case half 22 in a section beside the communicating passage 68, which is in the upper part of the second breather chamber 66 when the rammer 10 is being used. The projection 81 receives one end of the pipe 69, which is inserted with an air-tight fit into a through hole 82 provided in the cover 77. The projection 81 is projectingly provided so that the open end of the pipe 69 is not completely closed. The other end of the pipe 69 is connected to the air cleaner 37 of the intake system 39.

Referring back to FIG. 6, labyrinth-forming walls 83 and 84 are projectingly provided on the outer surface of the first case half 22 within the cavity 76 so as to be in contact with the cover 77. A labyrinth is formed within the second breather chamber 66 by the labyrinth-forming wall 83 so as to provide a connection between the communicating passage 68 and the pipe 69. Another labyrinth providing a connection between the second through passage 67 and the pipe 69 is formed within the second breather chamber 66 by the other labyrinth-forming wall 84.

The second through passage 67 communicates with the lower part of the second breather chamber 66 when the rammer 10 is being used. The second through passage 67 is formed from a passage hole 85 that is directly provided in the first case half 22 so as to communicate with the second breather chamber 66 and a pipe 86 that is secured to the first case half 22 so as to communicate with the passage hole 85. A flat mounting seat 88 facing the crank chamber 13 is formed in a section of the first case half 22 that lies beneath the second breather chamber 66 when the rammer 10 is being used. The passage hole 85 is provided in the first case half 22 so as to connect the second breather chamber 66 to the mounting seat 88. The pipe 86 has a flange 86*a* that is in contact with the mounting seat 88, and is formed so as to be substantially L-shaped. The flange 86*a* is secured to the mounting seat 88 by a bolt 87. One end of the pipe 86 is inserted with a liquid-tight fit into one end of the passage hole 85 on the mounting seat 88 side.

When the rammer 10 is not being used, the engine main body 11 may be laid sideways so that the axis of the cylinder bore 16 becomes substantially horizontal as shown in FIGS. 7A to 7D. The second through passage 67 is therefore formed so that the open end thereof within the crank chamber 13 is positioned above the oil level L within the crank chamber 13 regardless of the orientation of the engine main body 11 shown in FIGS. 7A to 7D when the engine main body 11 is laid sideways so that the axis of the cylinder bore 16 becomes substantially horizontal.

Figures 7A, 7B, 7C, 7D:
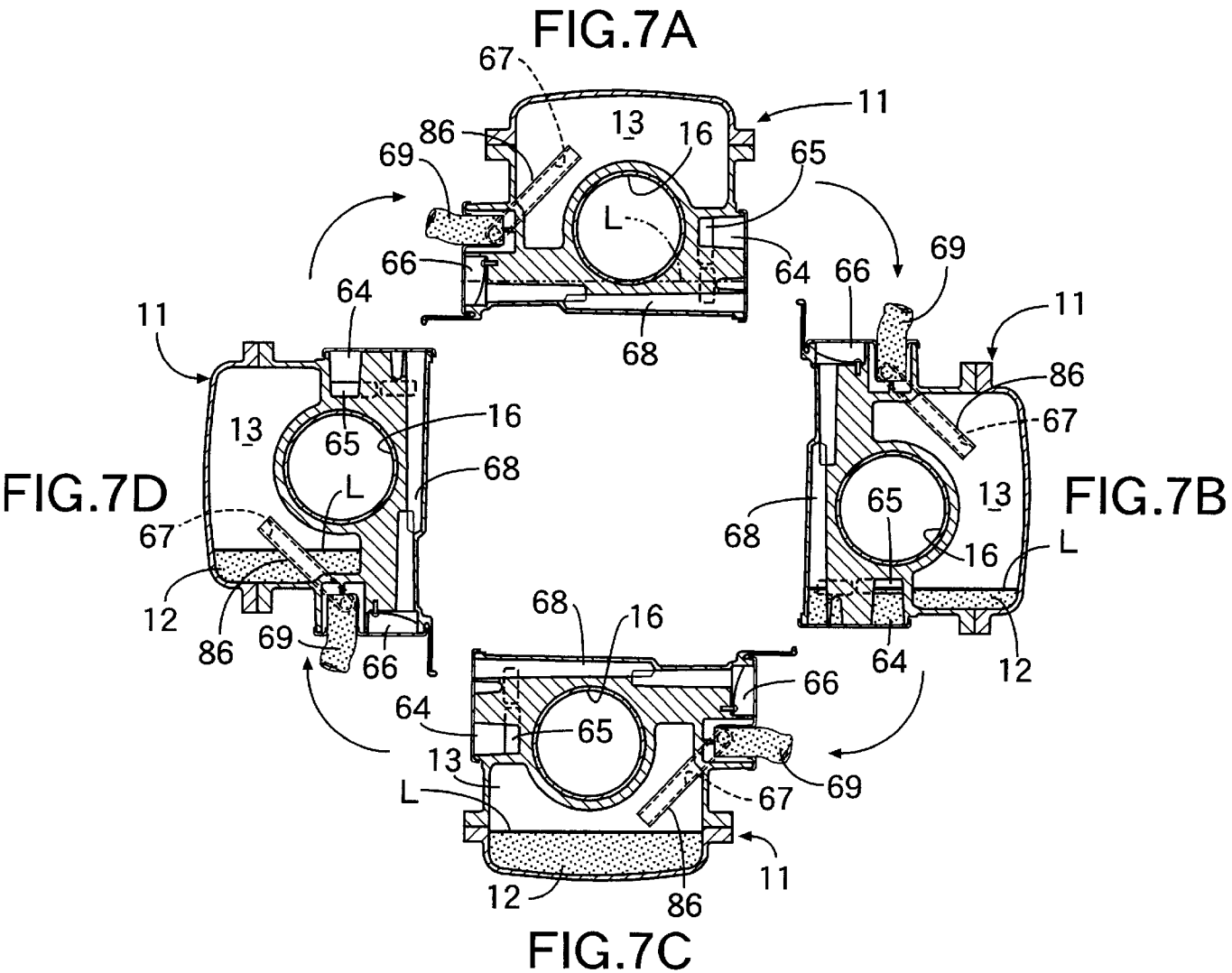
FIGS. 7A to 7D each show a cross section showing states in which the attitude of an engine main body that has been laid down is changed by 90 degrees each time.

When the engine main body 11 is in a laid-sideways state so that the communicating passage 68 is positioned beneath the axis of the cylinder bore 16, that is, in the state shown in FIG. 7A, the oil level L of the oil 12 is at a position that allows the oil 12 to enter the first breather chamber 64 via a part of the first through passage 65. There is therefore a possibility that the oil 12 flows from the first breather chamber 64 to the second breather chamber 66 side via the communicating passage 68. However, the route from the first through passage 65 to the communicating passage 68 via the first breather chamber 64 is made in a shape that can prevent the oil 12 within the crank chamber 13 from entering the communicating passage 68. That is, in this embodiment, when the engine main body 11 is laid sideways so that the communicating passage 68 is positioned beneath the axis of the cylinder bore 16, the oil level is at a position denoted by the broken line L' in FIG. 5, and the labyrinth-forming walls 74 provided in the first case half 22 so as to form a labyrinth within the first breather chamber 64 are made in a shape that prevents the oil 12 that has flowed into the first breather chamber 64 via the first through passage 65 from entering the communicating passage 68.

The operation of this embodiment is explained below. The first case half 22 of the engine main body 11 includes the first breather chamber 64, the first through passage 65 for providing communication between the first breather chamber 64 and the crank chamber 13, the second breather chamber 66 positioned in the vicinity of the intake system 39 on the side substantially opposite the first breather chamber 64 relative to the axis of the cylinder bore 16, the second through passage 67 for providing communication between the second breather chamber 66 and the crank chamber 13, and the communicating passage 68 that provides communication between the first and second breather chambers 64 and 66. When the rammer 10 is being used, the first and second through passages 65 and 67 are connected to lower parts of the first and second breather chambers 64 and 66 that are positioned above the oil level within the crank chamber 13, and the communicating passage 68 is positioned so as to open into the upper part of the second breather chamber 66. The air cleaner 37 of the intake system 39 is connected to the pipe 69, which communicates with the upper part of the second breather chamber 66 when the rammer 10 is being used.

When the rammer 10 is being used, breather gas that is generated within the crank chamber 13 is therefore guided to the intake system 39 via the first through passage 65, the first breather chamber 64, the communicating passage 68, the second breather chamber 66, and the pipe 69, and is also guided to the intake system 39 via the second through passage 67, the second breather chamber 66, and the pipe 69.

Each of the first and second breather chambers 64 and 66 has a labyrinth within it. The oil separated from the breather gas flowing through these labyrinths is returned to the crank chamber 13 through the first and second through passages 65 and 67, thereby enhancing the gas-liquid separation performance.

Furthermore, the second through passage 67 is formed so that its open end within the crank chamber 13 is positioned above the oil level L within the crank chamber 13 regardless of the orientation of the engine main body 11 when the engine main body 11 is laid sideways so that the axis of the cylinder bore 16 becomes substantially horizontal. It is therefore possible to prevent the oil 12 within the crank chamber 13 from entering the second breather chamber 66 via the second through passage 67 regardless of the attitude of the engine main body 11 when the engine main body 11 is laid sideways so that the axis of the cylinder bore 16 becomes substantially horizontal while the rammer 10 is not being used.

Moreover, the route from the first through passage 65 to the communicating passage 68 via the first breather chamber 64 is made in a shape that can prevent the oil 12 within the crank chamber 13 from entering the communicating passage 68 when the engine main body 11 is laid sideways so that the communicating passage 68 is positioned beneath the axis of the cylinder bore 16. The oil 12 within the crank chamber 13 therefore does not enter the second breather chamber 66 from the first through passage 65 via the first breather chamber 64 and the communicating passage 68.

As a result, the oil 12 within the crank chamber 13 does not enter the second breather chamber 66 regardless of the orientation of the engine main body 11 when it is laid sideways so that the axis of the cylinder bore 16 becomes substantially horizontal. It is possible to reliably prevent the oil 12 from entering the intake system 39 and white smoke from being discharged from the exhaust muffler 40 when the engine E is started, thereby contributing to an enhancement of the exhaust properties.

Furthermore, since the first and second breather chambers 64 and 66 are provided in the engine main body 11 in the structure for preventing the oil 12 from entering the intake system 39, the overall dimensions of the engine E do not increase.

The second through passage 67 is formed from the passage hole 85, which is formed directly in the first case half 22 of the engine main body 11 so as to communicate with the second breather chamber 66, and the pipe 86 secured to the first case half 22 so as to communicate with the passage hole 85. The second through passage 67, which has a complicated shape so that its open end is positioned above the oil level within the crank chamber 13 regardless of the attitude of the engine main body 11 when the engine main body 11 is laid sideways so that the axis of the cylinder bore 16 becomes substantially horizontal, can be formed by a simple arrangement.

The rammer 10 might be positioned in an orientation different from its normal attitude during operation due to operating error, unstable ground, etc. For example, a case is assumed where operation of the engine E is continued in a state in which the first breather chamber 64 is beneath the second breather chamber 66 as shown in FIG. 7B, and the first breather chamber 64 is filled with the oil 12 so that the oil level is above the end of the communicating passage 68 that opens into the first breather chamber 64. The communicating passage 68 provides connection between the first and second breather chambers 64 and 66.

In this case, in the compression stroke of the engine E, the gas within the second breather chamber 66 is sucked toward the crank chamber 13 in response to the crank chamber 13 having a negative pressure. Furthermore, in the expansion stroke of the engine E, since the crank chamber 13 has a positive pressure, the gas within the crank chamber 13 is pushed away via the second breather chamber 66 toward the intake system 39, and the oil within the first breather chamber 64 ascends within the communicating passage 68 while opening the one-way valve 80 by the action of the positive pressure.

In the following exhaust stroke of the engine E, the gas within the second breather chamber 66 is sucked toward the crank chamber 13 in response to the crank chamber 13 having a negative pressure. At this point, although the one-way valve 80 remains closed since the pressure working on the first breather chamber 64 is the same as that on the second breather chamber 66, the pressure of the second breather chamber 66 becomes the same as that of the space above the oil surface within the communicating passage 68 due to the pressure relief hole 90 provided in the valve body 80*a* of the one-way valve 80. The oil ascending within the communicating passage 68 therefore falls down within the communicating passage 68 due to its own weight.

Furthermore, when the engine E is brought into the intake stroke, the crank chamber 13 has a positive pressure. As in the expansion stroke, the gas within the crank chamber 13 is pushed away via the second breather chamber 66 toward the intake system 39, and the oil within the first breather chamber 64 ascends within the communicating passage 68 while opening the one-way valve 80 by the action of the positive pressure.

In this way, since the pressure relief hole 90 provided in the valve body 80*a* of the one-way valve 80 allows the oil level within the communicating passage 68 to decrease when the crank chamber 13 has a negative pressure, the oil level within the communicating passage 68 only rises and falls repeatedly even when operation of the engine E is continued. The oil is not pushed up toward the second breather chamber 66, thereby preventing the oil from leaking into the intake system 39 from the second breather chamber 66.

However, if there is no pressure relief hole 90 provided in the one-way valve 80, when the crank chamber 13 has a positive pressure, the oil ascends within the communicating passage 68. When the crank chamber 13 has a negative pressure, since the space above the oil surface within the communicating passage 68 becomes a sealed space, the oil level within the communicating passage 68 does not decrease, and the oil level within the communicating passage 68 increases to reach the second breather chamber 66 by continued operation of the engine E, and the oil might finally leak into the intake system 39.

In accordance with the present invention, even when operation of the engine is continued in a state in which the first breather chamber is below the second breather chamber, the first breather chamber being filled with oil so that the oil level is above the open end, on the first breather chamber side, of the communicating passage, if the crank chamber has a negative pressure the oil level within the communicating passage decreases by the action of the negative pressure acting on the first breather chamber due to the pressure relief hole provided in the one-way valve, and the oil is not pushed up toward the second breather chamber, thereby preventing the oil from leaking into the intake system.

The present invention is not limited by the embodiments described above and can be modified in a variety of ways without departing from the spirit and scope of the claims.

What is claimed is:

1. An engine breather system comprising:

a first breather chamber communicating with a crank chamber formed within a crankcase;

a second breather chamber communicating with the crank chamber and with an intake system;

a communicating passage connecting the first and second breather chambers; and a one-way valve provided at an open end, on the second breather chamber side, of the communicating passage so as to prevent breather gas from flowing from the second breather chamber toward the first breather chamber;

wherein the one-way valve is provided with a pressure relief hole.

2. The engine breather system of claim 1, further comprising labyrinth walls which form a labyrinth with the first breather chamber in a shape that prevents oil that has flowed into the first breather chamber via a first through passage from entering the communication passage.

3. The engine breather system of claim 1, further comprising:

a first through passage connecting the first breather chamber to the communication passage; and a second through passage connecting the second breather chamber to the communication passage;

wherein the first and second breather chambers have a labyrinth disposed therein, such that oil separated from breather gas flowing through the labyrinths of the first and second breather chambers is returned to the crank chamber through the first and second through passages.

4. The engine breather system of claim 1 further comprising a second through passage formed so that the open end thereof, within the crank chamber, is positioned above an oil level within the crank chamber regardless of an orientation of the engine breather system.

5. The engine breather system of claim 1 further comprising a flow path from a first through passage to the communication passage, via the first chamber, wherein the flow path is made in a shape that prevents oil within the crank chamber from entering the communication passage when the engine breather system is laid sideways such that the communication passage is positioned beneath an axis of a cylinder bore.

* * * * *